US005242506A

United States Patent [19]

Barber et al.

[11] Patent Number: 5,242,506

[45] Date of Patent: Sep. 7, 1993

[54] RHEOLOGICALLY CONTROLLED GLASS LUBRICANT FOR HOT METAL WORKING

[75] Inventors: Raymond J. Barber, Columbus; David R. Dorrell, Midland, both of Ga.

[73] Assignee: United Technologies Corporation, Hartford, Conn.

[21] Appl. No.: 852,840

[22] Filed: Mar. 16, 1992

Related U.S. Application Data

[63] Continuation of Ser. No. 600,637, Oct. 19, 1990, abandoned.

[51] Int. Cl.[5] ..... B23K 35/34

[52] U.S. Cl. ..... 148/22; 252/28

[58] Field of Search ..... 148/22; 252/28–30

[56] References Cited

U.S. PATENT DOCUMENTS

| | | | |
|---|---|---|---|
| 3,459,602 | 8/1969 | Mueller | 148/22 |
| 3,635,068 | 1/1972 | Watmough et al. | 72/342 |
| 4,096,076 | 6/1978 | Spiegelberg | 252/30 |
| 4,228,690 | 10/1980 | Corti et al. | 72/42 |
| 4,281,528 | 8/1981 | Spiegelberg et al. | 72/46 |
| 4,571,983 | 2/1986 | Sanborn et al. | 72/462 |

FOREIGN PATENT DOCUMENTS

| | | |
|---|---|---|
| 0007793 | 2/1980 | European Pat. Off. . |
| 0164637 | 12/1985 | European Pat. Off. . |
| 2339671 | 8/1977 | France . |
| 2118205 | 10/1983 | United Kingdom . |

*Primary Examiner*—Peter D. Rosenberg
*Attorney, Agent, or Firm*—Charles E. Sohl

[57] ABSTRACT

A rheologically controlled glass lubricant for hot metal working comprises a glass powder, a binder, a rheological agent, and a wetting and viscosity modifier. These materials may be dispersed in a carrier. The lubricant is made by mixing the constituent elements, milling the mixture, and stabilizing the milled mixture. The lubricant can be used in a forging operation by coating a metal part with the lubricant, heating the coated part, placing the coated heated part in a forge, and rapidly applying sufficient pressure to deform the coated metal part into a desired shape.

39 Claims, 1 Drawing Sheet

RHEOLOGICALLY CONTROLLED GLASS LUBRICANT FOR HOT METAL WORKING

This is a continuation of U.S. application Ser. No. 07/600,637, filed Oct. 19, 1990, now abandoned./

TECHNICAL FIELD

The present invention relates to a lubricant for hot metal working. In particular, it relates to a lubricant for the precision forging of superalloys for turbine engines.

BACKGROUND ART

The manufacture of precision engineered machines such as jet engines requires that various metal component parts be hot worked by forging, extruding, rolling, or by similar processes. These processes entail rapidly applying high pressure by means of a metal die or other tool to the part being worked to induce a high strain rate. The tools are often made of various steels such as H13 type tool steel. The parts are typically fabricated from materials such as titanium alloys, nickel alloys, or stainless steels. To facilitate these processes, the part and the tool are coated with a lubricant which minimizes friction between the part and tool and prevents metal to metal contact.

One class of hot metal working lubricants which is widely used is glass lubricants. These lubricant comprise ground glass particles which are suspended in a carrier. Such lubricants are applied to the part to be worked to reduce friction and minimize metal to metal contact which results in damage to the tool and part. Examples of commercially available lubricants include GP-803 available from Graphite Products (Brookfield, Ohio) and Deltaglaze TM 13 and 17 available from Acheson Colloids (Port Huron, Mich.).

Despite the use of commercially available glass lubricants, some materials remain difficult to hot work, especially in precision or net forging operations. Titanium alloys in particular have proven troublesome. Due to their high strength, these alloys require extremely high pressures in order to be worked, resulting in high friction conditions which commercially available lubricants cannot obviate entirely. For example, forge loads of 500 tons to 2000 tons, which can result in surface pressures in excess of 100 tons per square inch or more, are typical. At these pressures, lubricants are subjected to high shear stresses and temperatures which cause them to lose their lubricating properties. The loss of lubricating properties is related to changes in viscosity, surface tension, density, and chemistry. Without adequate lubrication, metal tools wear rapidly and friction between the tool and part often ruptures the surface of the part. In addition, metal to metal contact occurring under these conditions can result in localized welding of the part to the tool, further damaging the part and tool. As a result, dies must be repaired or replaced frequently and parts can require extensive reworking.

Accordingly, much effort has been made in the past to develop lubricants which can reduce the friction between a tool and part in hot working operations which are carried out at extremely high pressures, but thus far has fallen short of meeting all of the objectives. Therefore, what is needed in this field is a lubricant which will be capable of operating at the extremely high pressures used to hot work titanium alloys and like materials.

Disclosure of the Invention

The present invention is directed towards providing a lubricant which can reduce friction between a tool and part in hot working operations which are carried out at extremely high pressures.

One aspect of the invention includes a rheologically controlled glass lubricant for hot metal working comprising a mixture of a glass powder, a binder, a rheological agent, and a wetting and viscosity modifier.

Another aspect of the invention includes a method of making a rheologically controlled glass lubricant for hot metal working, comprising mixing a glass powder, a binder, a rheological agent, and a wetting and viscosity modifier; and milling the mixture. A carrier can be included with the mixture and the mixture can be stabilized.

Another aspect of the invention includes a method of forging metal, comprising coating a metal part with a rheologically controlled glass lubricant. The lubricant comprises a mixture of a glass powder, a binder, a rheological agent, and a wetting and viscosity modifier. The coated metal part is heated, placed in a forge and sufficient pressure to deform the coated metal part into a desired shape is rapidly applied.

Another aspect of the invention includes a forged metal part with a smooth, rupture-free surface comprising a metal body formed into a desired shape by coating the metal body with a rheologically controlled glass lubricant. The lubricant comprises a mixture of a glass powder, a binder, a rheological agent, and a wetting and viscosity modifier. The coated metal body is heated, placed in a forge and sufficient pressure to deform the coated metal body into a desired shape is rapidly applied.

The foregoing and other features and advantages of the present invention will become more apparent from the following description and accompanying drawings.

BEST MODE FOR CARRYING OUT THE INVENTION

Figure 1:
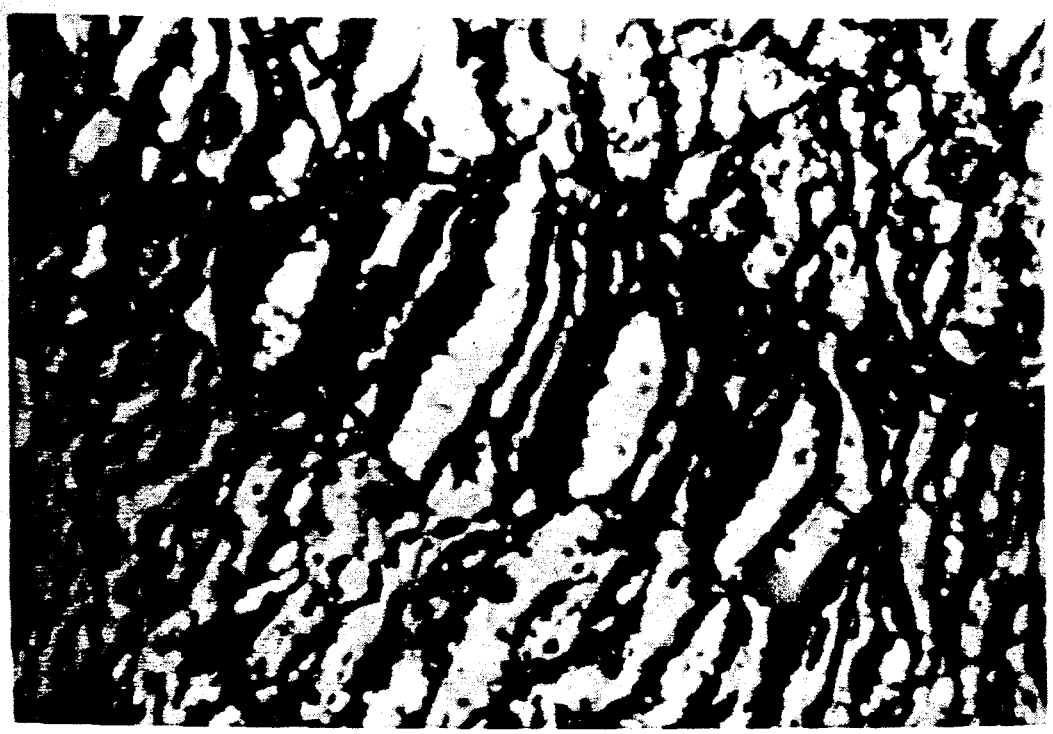
FIG. 1 shows a titanium alloy forging for which a prior art glass lubricant was used.

The present invention is an improved lubricant for hot metal working under extremely high pressures. It comprises a mixture of a glass powder, a binder, a rheological agent, and a wetting and viscosity modifier. These components may be either a dry mixture or dispersed in a carrier. This combination of materials provides a lubricant which does not lose its lubricating properties when subjected to high pressures, temperatures, and shear stresses. The lubricant may be used with a wide variety of metals and metal working operations.

The glass powder provides the basic lubricating activity of the present invention, especially when the part being hot worked is subjected to mild pressures, by fusing to form a continuous lubricating coating on the part when it is heated prior to the metal working operation. This continuous lubricating coating will be referred to as the glass base lubricant or base lubricant. The glass powder may be any of a number of glass powders or frits which have been used in the manufacture or formation of existing hot metal working lubricants. Generally, any glass powder with a viscosity of between about $10^2$ poises to about $10^4$ poises at a working temperature of about 1650° F. to about 2100° F. would be suitable. Typically, such a glass powder will have a softening point of about 1200° F. and an as received particle size of about 150 microns to about 0.5 millimeters. Glass powder suitable for use at temperatures up to about 1750° F. is available from Specialty Glass (Oldsmar, Fla.) and can have the following composition: 1 % by weight (%wt) to 3 %wt $Al_2O_3$; 25%wt to 35%wt PbO; <0.1% wt MgO; <0.5 %wt CaO; 5%wt to 8.5%wt $Na_2O$; balance $SiO_2$. Of course, one skilled in the art will realize that this is but one of many compositions which would be suitable for use with this invention. The glass powder should make up about 48%wt to about 55%wt of the lubricant.

The binder improves the adhesion of the lubricant to the surface to which it is applied by forming a mechanical bond with the surface. Suitable binders include alkyd and silicone resins; water based emulsions such as vinyl acetate and vinyl alcohol; and thermoplastic resins such as polyacrylates, polyvinyl benzene, and styrene butadienes. The preferred binder is a styrene butadiene. The binder should make up between about 5%wt to about 20%wt of the lubricant. Preferably, the binder will make up about 15%wt of the lubricant. The binders may be dissolved in a compatible carrier such as xylene; trichloroethylene; glycol ether; alcohols, such as methyl alcohol and isopropyl alcohol; ketones, such as methylethyl ketone; or water. Xylene is the preferred organic carrier, while water is the preferred inorganic carrier.

Commercially available products which comprise a suitable glass powder and binder dispersed in a carrier may be used to supply the glass powder and binder. Suitable products include GP-803, available from Graphite Products (Brookfield, Ohio), and Deltaglaze TM 13 and 17, available from Acheson Colloids (Port Huron, Mich.). The preferred commercial product for use with this invention is Deltaglaze TM 17 because it uses xylene as a carrier. If a commercial product is used, sufficient product should be used to provide the above specified amounts of glass powder and binder in the final lubricant.

The rheological agent serves to control the flow of the liquid glass base lubricant, hence the use of term rheological agent. Secondarily, the rheological agent supports the load on the part and prevents metal to metal contact between the part and tool when the hydrodynamic glass base lubricant film suffers catastrophic breakdown at high pressure. The rheological agent should be able to function as a lubricant under pressures above about 40 tons/in$^2$. Typically, materials such as BN, Ni, NiO, and $Cr_2O_3$ will meet this requirement. They are incorporated into the invention as particles which may be suspended in the carrier. BN is the preferred rheological agent because it has a laminar structure. The particles should be about 5 microns to about 40 microns in diameter. Preferably, the particles will be about 6 microns to about 15 microns in diameter. They make up between about 3%wt and about 6%wt of the lubricant. Preferably, they will make up about 5%wt to about 6%wt of the lubricant.

The wetting and viscosity modifier alters and controls the flow properties or rheology of the glass base lubricant to extend the range of pressures over which it will provide good lubricating properties by preventing the viscosity of the glass base lubricant from breaking down at high pressures. Compounds which are silica lattice modifiers make suitable wetting and viscosity modifiers. Preferred compounds include sodium tetraborate, potassium tetraborate, boric acid, lead monosilicate, and lead bisilicate. Potassium tetraborate is the most preferred viscosity modifier because of its effect on viscosity adjustment. The viscosity modifier should make up about 4%wt to about 8%wt of the lubricant. Preferably, the lubricant will comprise 5%wt to about 7%wt viscosity modifier.

The glass powder, binder, rheological agent, and wetting and viscosity modifier may be a dry mixture or may be dispersed in a carrier. Preferably, the materials will be dispersed in a carrier to make the lubricant more convenient to apply. If the glass powder and binder are already dispersed in a carrier, as would be the case if a commercial product were the source of these components, any additional carrier must be compatible with the carrier in which the glass powder and binder are dispersed. Preferably, any additional carrier will be the same material used as a carrier for the glass powder and binder. The carrier may be any of a number of organic or inorganic materials including xylene; trichloroethylene; glycol ether; alcohols, such as methyl alcohol and isopropyl alcohol; ketones, such as methylethyl ketone; or water. Xylene is a preferred carrier. The carrier should make up between 35%wt to about 45%wt of the lubricant. Preferably, it will be about 38%wt to about 42%wt.

The invention is made by mixing the glass powder, binder, rheological agent, viscosity modifier, and carrier, if any, and milling them in a reduction mill, such as a ball mill, until the mixture is homogeneous and the particles are of a suitable size. The majority of the glass particles should be between 1 micron and 30 microns in diameter after milling. Preferably, the majority of the particles should be 5 microns to 12 microns in diameter. The milling operation may take up to 8 hours.

If the lubricant contains a carrier, the milling operation produces a complex suspension whose viscosity will tend to fluctuate during the first several hours after it is prepared, making its properties somewhat unpredictable. Therefore, the lubricant should be stabilized before use to ensure adequate results. One way to stabilize the lubricant is to store it in sealed containers for at least 24 hours and preferably for at least 48 hours to permit it to age. Another way to stabilize the lubricant is to put it into a dynamic storage device, such as a constantly rotating container. Dynamic storage prevents viscosity fluctuation by constantly mixing the lubricant. If the lubricant is stored in a dynamic storage device, it may be used at any time after preparation. If the lubricant is a dry mixture, it needs no stabilization and can be used immediately after preparation.

The finished lubricant may be applied to a part to be worked by any appropriate method. For example, if the lubricant is a mixture dispersed in a carrier, it can be applied by painting, dipping, electrostatic spraying, or conventional spraying. If the lubricant is a dry mixture, it can be applied by conventional spraying, electrostatic spraying, electrophoretic application, or by placing a heated part in a fluidized bed of the lubricant. Regardless of whether the lubricant is a wet or dry mixture, it should form a dry film of about 0.004 g/cm$^2$ to about 0.015 g/cm$^2$ when applied to the part to be worked. This loading corresponds to a coating of about 0.001 inch (in) to about 0.005 in thick. If the film is too thin, it will not provide adequate lubrication. If the film is too thick, poor metal flow will result when operating pressures are applied. Preferably, the lubricant will form a dry film of about 0.0060 g/cm$^2$ to about 0.0107 g/cm$^2$, corresponding to a coating of about 0.002 in to about 0.003 in thick, especially when it is to be used with titanium alloys. If a test sample of the coating is found to be too thick, additional carrier may be added to dilute the lubricant. If the coating is too thin, carrier may be allowed to evaporate from the lubricant or a thixotrope may be added. Thixotropes are inorganic or organic rheological additives which can thicken the lubricant. They must be compatible with the carrier used in the lubricant. Preferred organic thixotropes include bentones, micronized hydrogenated castor oil, castor oil, ethane diol, or methyl cellulose. Preferred inorganic thixotropes include fumed silica, bentonite, or water.

If the lubricant has a carrier, it must be dried after being applied to the part. This can be accomplished by heating the lubricant to a temperature above the solvent's boiling point or by allowing the lubricant to air dry. If the lubricant is a dry mixture, it needs no drying. After the lubricant has been dried, the part must be heated to fuse the glass powder into the base lubricant. The part must be heated to at least the softening point of the glass. Once the glass powder has fused, the part is ready to be hot worked.

The lubricant may be used with a wide range of metals in a number of different hot working operations. For example, the lubricant has been found to be suitable for use with titanium alloys, particularly Ti8-1-1, Ti6-4, and Ti6-2-4-2 over the temperature range of about 1735° F. to about 1840° F. It is also compatible with nickel alloys and stainless steels used in aerospace engines and commonly called superalloys. The lubricant is useful in reducing friction in forging operations in general, and particularly in conventional precision or net forging operations in which pressure is rapidly applied to the part to be worked, inducing a high strain rate. It can also be used to reduce friction in extrusion, blocking, heading, and rolling operations. The lubricant can be used at temperatures ranging from about 1560° F. up to the temperature at which the rheological agent decomposes. If the working temperature is much below about 1560° F., the lubricant will be too stiff to function properly. Preferably, the minimum working temperature will be about 1650° F.

EXAMPLE

A ball milling machine manufactured by U.S. Stoneware (Mahwah, N.J.) was prepared for mixing the lubricant. 12 kg of pebbles were milled in a ball mill jar in the presence of 1 kg of abrasive material and an ample amount of clean water for 48 hours in order to condition the media. The abrasive material was then removed and the water and any very small or split pebbles were discarded. The jar and its pebble charge were thoroughly dried.

After the jar and pebbles were dry, 6.245 kg of Deltaglaze TM 17 (available from Acheson Colloids, Port Huron, Mich.) and 915.4 g of xylene were added to the jar. 432.4 g of BN particles available as Grade HCP from Union Carbide Coatings Service Corp. (Cleveland, Ohio) were carefully added to the jar. Finally, 506.6 g of potassium tetraborate available from United States Borax Corp. (Los Angeles, Calif.) were added to the jar. The ball mill jar was place on the mill and the mill was started. After 7 hours, the mill was stopped and the jar was removed. The lubricant was strained into a clean metal can through a muslin cloth and a straining plate. The can was closed and the lubricant was permitted to age for 48 hours.

After the aging period was over, the can was opened and the lubricant was gently stirred with a wooden paint stirrer to ensure that all sediment was blended into the body of the lubricant. While stirring, care was taken to avoid entrapping air in the lubricant. A clean, chemically milled metal extrusion was dipped into the lubricant and hung up to dry for 1 hour at ambient temperature. When dry, the coating thickness was measured with a micrometer and found to be 0.0025 in thick. As this thickness was within the preferred range of 0.002 in to 0.003 in, which corresponds to a loading of about 0.01 g/cm$^2$, no additional carrier was needed.

This invention was found to drastically reduce wear on forging dies and surface damage to titanium alloy parts when applied to the parts prior to forging. For example, die life measured in average pieces per die improved by up to 300% to 400% when a prior art lubricant was replaced with the invention for forging titanium alloy parts. The decrease in die wear is attributed to the improved ability of the invention to reduce friction and prevent metal to metal contact between the part and die during forging at extremely high pressures.

Figure 2:
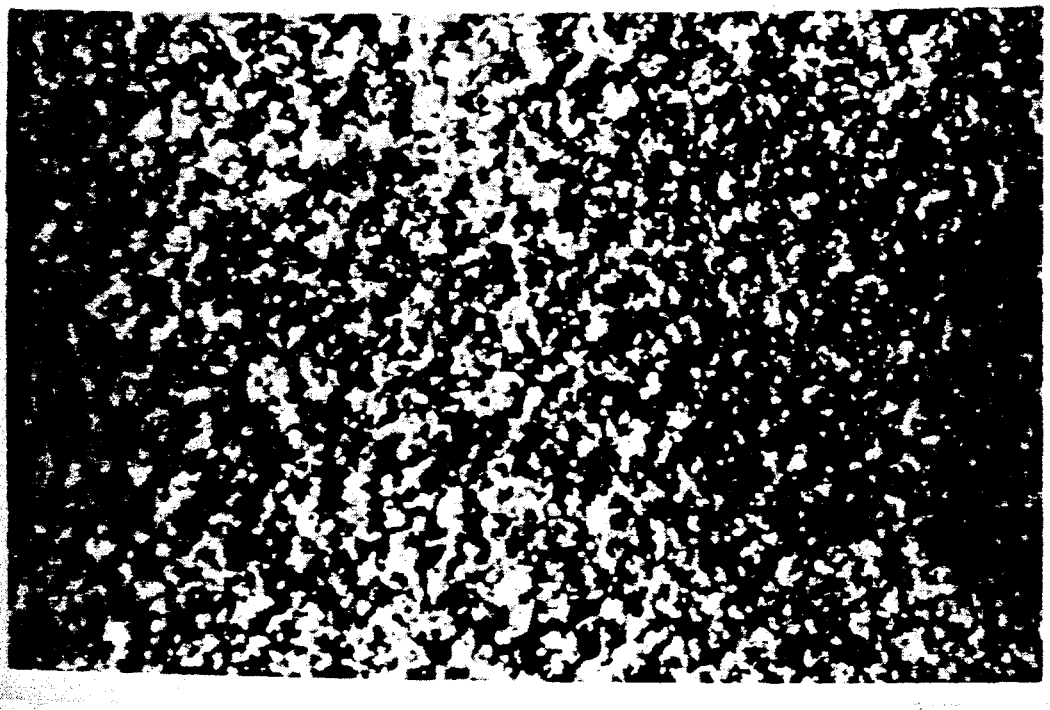
FIG. 2 shows a titanium alloy forging for which the present invention was used as a lubricant.

A comparison of FIGS. 1 and 2 shows the improvement to the part surface which results from using the invention. FIG. 1 is a photomicrograph of the surface of a Ti6-2-4-2 part which was coated with a prior art lubricant before forging. Areas of shearing and surface rupture which result from metal to metal contact with the die are evident. This sort of damage to the part results in corresponding damage to the die which must be repaired by dressing, a hand operation which reduces die life. A part with damage like this is unacceptable as a finished piece and must be reworked by hand to repair the surface.

FIG. 2 is a photomicrograph of the surface of a similar Ti6-2-4-2 part which was coated with a lubricant of a composition similar to that disclosed in the example before forging. The surface is uniform and displays no evidence of shearing or rupture. This is evidence of little or no metal to metal contact between the part and die. A part with a surface like this is acceptable as a finished piece and needs no reworking.

The improved die life and decreased part damage result from improved lubrication and less metal to metal contact at forging conditions. The viscosity modifier in the invention enhances the glass base lubricant so it can provide lubrication at the extremely high pressures encountered when forging titanium alloy and nickel and stainless steel superalloy parts. The rheological agent controls glass base lubricant flow and provides additional lubrication under these pressures and helps to prevent metal to metal contact.

The invention also improves the movement or deformation of the metal being forged by decreasing the friction between the tool and the part. As a result, when the invention is used as the lubricant, lower forge pressures are needed to achieve the desired deformation than if a prior art lubricant is used. The lower forging pressures further improve die life and decrease part damage.

Decreased die wear means that dies need to be replaced less frequently and require less hand dressing to repair damage. The improvement to the part surface reduces or eliminates the need for hand repair. Another benefit of reduced part damage is improved dimensional reproducibility of the parts. Because the parts do not require hand working, each part is more uniform. This can also be expressed as an improvement in process control because the results obtained during the forging operation are more uniform and predictable.

The fact that dies do not need to replaced as frequently and parts do not require extensive rework means that forge throughput can be increased for the same expenditures in materials and labor. Alternately, throughput can be held constant and material and labor requirements can be decreased.

Finally, the range of temperatures over which the lubricant can function was found to be broader than that of many prior art lubricants. Therefore, it is possible to use the invention for a wider range of applications than is possible with a single prior art lubricant. This can simplify inventory requirements because, in essence, the invention can replace several prior art lubricants.

It should be understood that the invention is not limited to the particular embodiment shown and described herein, but that various changes and modifications may be made without departing from the spirit and scope of the claimed invention.

Having thus described the invention, what is claimed is:

1. A rheologically controlled glass lubricant for hot metal working, comprising a mixture of:

(a) a glass powder comprising about 25%wt to about 35%wt PbO and about 5%wt to about 8.5%wt $Na_2O$, wherein the glass powder is capable of forming a glass base lubricant on a metal part that will be hot worked;

(b) a binder capable of improving the adhesion of the lubricant to the metal part;

(c) a rheological agent capable of functioning as a lubricant at pressures above those at which the glass base lubricant breaks down; and (d) a wetting and viscosity modifier capable of inhibiting the viscosity of the glass base lubricant from breaking down at high pressures, thereby extending the range of pressures over which the glass base lubricant has lubricating properties.

2. The glass lubricant of claim 1 further comprising a carrier.

3. The glass lubricant of claim 1 wherein the glass powder has a particle size of about 1 micron to about 30 microns and a viscosity of about $10^2$ poises to about $10^4$ poises when heated to metal working temperatures.

4. The glass lubricant of claim 2 comprising about 48%wt to about 55%wt glass powder.

5. The glass lubricant of claim 1 wherein the binder is selected from the group consisting of alkyd and silicone resins, water based emulsions, and thermoplastic resins.

6. The glass lubricant of claim 1 wherein the binder is a styrene butadiene.

7. The glass lubricant of claim 2 comprising about 5%wt to about 20%wt binder.

8. The glass lubricant of claim 1 wherein the rheological agent is selected from the group consisting of BN, Ni, NiO, and $CrO_2O_3$.

9. The glass lubricant of claim 1 wherein the rheological agent is BN.

10. The glass lubricant of claim 2 comprising about 3%wt to about 6%wt rheological agent.

11. The glass lubricant of claim 1 wherein the wetting and viscosity modifier is selected from the group consisting of sodium tetraborate, potassium tetraborate, boric acid, lead monosilicate, and lead bisilicate.

12. The glass lubricant of claim 1 wherein the wetting and viscosity modifier is potassium tetraborate.

13. The glass lubricant of claim 2 comprising about 4%wt to about 8%wt wetting and viscosity modifier.

14. The glass lubricant of claim 2 wherein the carrier is selected from the group consisting of xylene, trichloroethylene, glycol ether, alcohols, ketones, and water.

15. The glass lubricant of claim 2 wherein the carrier is xylene.

16. The glass lubricant of claim 2 comprising about 35%wt to about 45%wt carrier.

17. The glass lubricant of claim 1 wherein the lubricant forms a dry film of about 0.004 $g/cm^2$ to about 0.015 $g/cm^2$ on a part to be worked.

18. A rheologically controlled glass lubricant for hot metal working, comprising a mixture of:

(a) a glass powder having a particle size of about 1 micron to about 30 microns and $a_o$ viscosity of about $10^2$ poises to about $10^4$ poises when heated to metal working temperatures;

(b) a binder selected from the group consisting of alkyd and silicone resins, water based emulsions, and thermoplastic resins;

(c) a rheological agent selected from the group consisting of BN, Ni, NiO, and $Cr_2O_3$;

(d) a wetting and viscosity modifier selected from the group consisting of sodium tetraborate, potassium tetraborate, boric acid, lead monosilicate, and lead bisilicate; and (e) a carrier selected from the group consisting of xylene, trichloroethylene, glycol ether, alcohols, ketones, and water.

19. The glass lubricant of claim 18 comprising about 48%wt to about 55%wt glass powder.

20. The glass lubricant of claim 18 comprising about 5%wt to about 20%wt binder.

21. The glass lubricant of claim 18 comprising about 3%wt to about 6%wt rheological agent.

22. The glass lubricant of claim 18 comprising about 4%wt to about 8%wt wetting and viscosity modifier.

23. The glass lubricant of claim 18 comprising about 35%wt to about 45%wt carrier.

24. A method of making a rheologically controlled glass lubricant for hot metal working, comprising:

(a) mixing a glass powder, a binder, a rheological agent, and a wetting and viscosity modifier, wherein the glass powder is capable of forming a glass base lubricant on a metal part that will be hot worked, the binder is capable of improving the adhesion of the lubricant to the metal part, the rheological agent is capable of functioning as a lubricant at pressures above those at which the glass base lubricant breaks down, and the wetting and viscosity modifier is capable of inhibiting the viscosity of the glass base lubricant from breaking down at high pressures, thereby extending the range of pressures over which the glass base lubricant has lubricating properties; and (b) milling the mixture.

25. A method of making a rheologically controlled glass lubricant for hot metal working, comprising:

(a) mixing a glass powder, a binder, a rheological agent, and a wetting and viscosity modifier, wherein the glass powder is capable of forming a glass base lubricant on a metal part that will be hot worked, the binder is capable of improving the adhesion of the lubricant to the metal part, the rheological agent is capable of functioning as a lubricant at pressures above those at which the glass base lubricant breaks down, and the wetting and viscosity modifier is capable of inhibiting the viscosity of the glass base lubricant from breaking down at high pressures, thereby extending the range of pressures over which the glass base lubricant has lubricating properties;

(b) milling the mixture; and (c) stabilizing the milled mixture.

26. The method of claim 25 wherein the mixture is milled until a majority of the glass powder particles are between 1 micron and 30 microns in size.

27. The method of claim 25 wherein the mixture is stabilized by storing it in a dynamic storage device.

28. The method of claim 25 wherein the mixture is stabilized by aging it for at least 24 hours.

29. The method of claim 25 wherein the binder is selected from the group consisting of alkyd and silicone resins, water based emulsions, and thermoplastic resins.

30. The method of claim 25 wherein the rheological agent is selected from the group consisting of BN, Ni, NiO, and $Cr_2O_3$.

31. The method of claim 25 wherein the wetting and viscosity modifier is selected from the group consisting of sodium tetraborate, potassium tetraborate, boric acid, lead monosilicate, and lead bisilicate.

32. The method of claim 25 wherein the carrier is selected from the group consisting of xylene, trichloroethylene, glycol ether, alcohols, ketones, and water.

33. A method of forging metal, comprising:

(a) coating a metal part with a rheologically controlled glass lubricant which comprises a mixture of:

(i) a glass powder capable of forming a glass base lubricant on the metal part;

(ii) a binder capable of improving the adhesion of the lubricant to the metal part;

(iii) a rheological agent capable of functioning as a lubricant at pressures above those at which the glass base lubricant breaks down; and (iv) a wetting and viscosity modifier capable of inhibiting the viscosity of the glass base lubricant from breaking down at high pressures, thereby extending the range of pressures over which the glass base lubricant has lubricating properties;

(b) heating the coated metal part;

(c) placing the coated metal part in a forge;

(d) rapidly applying sufficient pressure to deform the coated metal part into a desired shape.

34. The method of claim 33 wherein the rheologically controlled glass lubricant further comprises a carrier.

35. The method of claim 34 further comprising drying the glass lubricant before heating the coated metal part.

36. The method of claim 33 wherein the binder is selected from the group consisting of alkyd and silicone resins, water based emulsions, and thermoplastic resins.

37. The method of claim 33 wherein the rheological agent is selected from the group consisting of BN, Ni, NiO, and $CrO_2O_3$.

38. The method of claim 33 wherein the wetting and viscosity modifier is selected from the group consisting of sodium tetraborate, potassium tetraborate, boric acid, lead monosilicate, and lead bisilicate.

39. The method of claim 34 wherein the carrier is selected from the group consisting of xylene, trichloroethylene, glycol ether, alcohols, ketones, and water.

* * * * *